US007244128B2

(12) United States Patent
Byrne

(10) Patent No.: US 7,244,128 B2
(45) Date of Patent: Jul. 17, 2007

(54) WATERPROOF SIMPLEX RECEPTACLE

(76) Inventor: Norman R. Byrne, 2736 Honey Creek, NE., Ada, MI (US) 49301

( * ) Notice: Subject to any disclaimer, the term of this patent is extended or adjusted under 35 U.S.C. 154(b) by 117 days.

(21) Appl. No.: 11/016,577

(22) Filed: Dec. 17, 2004

(65) Prior Publication Data

US 2006/0134998 A1 Jun. 22, 2006

(51) Int. Cl.
*H01R 13/648* (2006.01)

(52) U.S. Cl. ..... 439/106; 439/685; 439/689

(58) Field of Classification Search ..... 439/106, 439/107, 685, 689, 686
See application file for complete search history.

(56) References Cited

U.S. PATENT DOCUMENTS 2,932,000 A * 4/1960 Buchanan ..... 439/569
4,372,629 A * 2/1983 Propst et al. ..... 312/223.6
4,747,788 A * 5/1988 Byrne ..... 439/131
4,984,982 A * 1/1991 Brownlie et al. ..... 439/131
5,485,309 A * 1/1996 Baranetz et al. ..... 359/485
5,575,668 A * 11/1996 Timmerman ..... 439/131
5,709,156 A * 1/1998 Gevaert et al. ..... 108/50.02
6,309,248 B1 * 10/2001 King ..... 439/535
6,454,612 B1 * 9/2002 Wang ..... 439/694
6,644,987 B2 * 11/2003 Meleck ..... 439/107
6,669,491 B2 * 12/2003 Yoji ..... 439/106

* cited by examiner

*Primary Examiner*—Gary F. Paumen
(74) *Attorney, Agent, or Firm*—Varnum, Riddering et al

(57) ABSTRACT

A simplex receptacle body (102) includes a front portion (108) with a front surface (104) and a rear surface (106). Terminals (110) extend through the front portion (108). A clip (138) is "snap-fit" on a rear housing (132), so as to provide waterproofing.

2 Claims, 3 Drawing Sheets

120
122
124
126
128
130
102
108
118
132
134
136
138
142
148
100

WATERPROOF SIMPLEX RECEPTACLE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to electrical systems and, more particularly, to electrical receptacles mounted in configurations where they may be susceptible to water or other liquid damage or danger.

2. Background Art

The use of computers, telecommunications equipment and other electronic devices is continuing to rapidly increase in office, commercial, industrial and other environments. As a result, the importance of efficiently supplying power throughout these environments is also increasing. Historically, one problem with use of electrical power is the positioning of electrical power outlet ports, such as electrical receptacles. Positioning of these devices is important with respect to both convenience and cost efficiency. Electrical receptacles for supplying power to various types of devices (lighting, computers, etc) must be located in accessible positions for all types of use.

In this regard, it is known to employ electrical receptacles directly mounted to various types of furniture, such as bookshelves and desks. These receptacles may be mounted at a location substantially above a floor surface, and allow the user to interconnect electrical devices near their locations of use, thereby avoiding the necessity of running device cords and cables a substantial distance.

A system employing covered receptacles mounted within a workstation is disclosed in Propst, U.S. Pat. No. 4,372,629 issued Feb. 8, 1993. The Propst arrangement includes a desk top having a rear cover hinged to a vertical back panel. Receptacles are mounted to the lower portion of the cover and bristles extend horizontally from the cover to an edge of the desktop when the cover is closed. When the cover is opened, the user can "plug in" the cord of a desired electrical device and close the cover, with the cord then extending through the bristles.

A further advance of the prior art was achieved with the commonly owned Byrne, U.S. Pat. No. 4,747,788 issued May 31, 1988. In this patent, a retractable power center is disclosed which is manually operable. The power center includes a movable and vertically slidable power carriage utilized to mount electrical receptacles. The carriage can be extended between an open position and a closed, retracted position.

In Brownlie, et al., U.S. Pat. No. 4,984,982 issued Jan. 15, 1991 an access flooring module is provided, which is mounted in an opening provided in a floor. The module is moveable between open and closed positions, so as to receive electrical components such as power sockets.

Timmerman, U.S. Pat. No. 5,575,668, issued Nov. 19, 1996 discloses a temporary power/data tap for delivery electrical power and data service to a work surface from a distant standard wall or floor mounted electrical receptacle. Another device comprising utility receptacles and specifically directed to use in a work surface is disclosed in Gevaert, et al., U.S. Pat. No. 5,709,156 issued Jan. 20, 1998.

In accordance with the foregoing, various types of configurations exist with respect to mounting electrical receptacles. However, one problem with a number of known electrical receptacles relates to the potential damage (or dangerous situations) from environmental conditions. For example, electrical receptacles may be constructed and configured in such a way as to be susceptible to damage from water or other fluids. As well known in the electrical industry, water spillage or the like may result not only in damage to electrical components, but may also cause dangerous situations, due to electrical arcing or similar electrical malfunctions caused by water spillage and seepage.

SUMMARY OF THE INVENTION

In accordance with the invention, a simplex receptacle is constructed in accordance with the invention, in a manner so as to provide substantial waterproof properties. The simplex receptacle includes a main body having electrical terminals. The terminals may include hot, neutral and ground terminals. Electrical wires or other cabling are electrically coupled to the terminals. A rear housing is provided, which is connected by any suitable means to a rear surface of the main receptacle body. A waterproofing clip is then positioned on the main body, so as to essentially enclose any openings which may exist in the rear portion of the simplex receptacle.

BRIEF DESCRIPTION OF THE SEVERAL VIEWS OF THE DRAWING

The invention will now be described with reference to the drawings, in which.

DETAILED DESCRIPTION OF THE INVENTION

Figure 2:
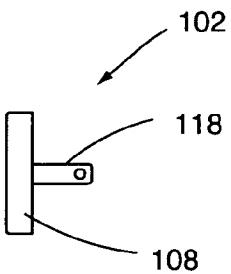
FIG. 2 is a right-side view of the simplex receptacle body shown in FIG. 1.
Figure 4:
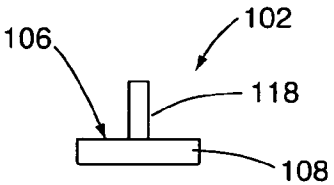
FIG. 4 is a plan view of the simplex receptacle body shown in FIG. 1.
Figure 1:
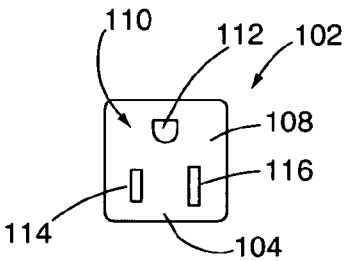
FIG. 1 is an elevation view of a simplex receptacle body, in accordance with the invention.
Figure 5:
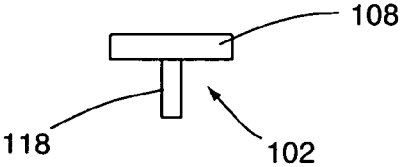
FIG. 5 is an underside view of the simplex receptacle body shown in FIG. 1.
Figure 3:
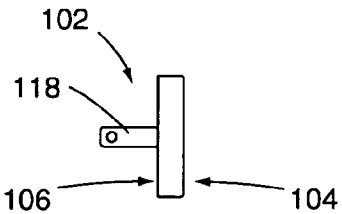
FIG. 3 is a left-side view of the simplex receptacle body shown in FIG. 1.

The principles of the invention are disclosed, by way of example, in a waterproof simplex receptacle 100. The waterproof simplex receptacle 100 will be described with respect to FIGS. 1-16. In accordance with the invention, the waterproof simplex receptacle includes a receptacle body having electrical wires or cables interconnected thereto. A rear housing is formed around the rear portion of the receptacle body, and substantially encloses the electrical wires or cables. For purposes of providing waterproof properties, a waterproofing clip is appropriately sized and configured so as to fit around portions of the rear housing, in a manner so as to "block" any openings and prevent any water seepage into the rear housing.

Turning to the drawings, FIGS. 1–5 illustrate, standing alone, a simplex receptacle body 102 in accordance with the invention. With specific reference to FIGS. 1–5, the receptacle body 102 includes a front portion 108 having a substantially square or otherwise rectangular configuration. The front portion 108 includes a front surface 104 and a rear surface 106. Extending through the front portion 108 are a series of three terminals 110. In the particular embodiment disclosed herein, the terminals include a ground terminal 112, neutral terminal 114 and hot terminal 116. These terminals are conventional in nature and well known in the prior art. Further, it should be emphasized that various other electrical terminal configurations can be utilized for a simplex receptacle in accordance with the invention, without departing from the basic novel concepts of the invention.

The simplex receptacle body 102 also includes a connecting mount 118, comprising an elongated element extending rearwardly from the rear surface 106 of the front portion 108. The connecting mount 118 can be utilized for appropriately securing various elements of the waterproof simplex receptacle 100.

Figures 6, 7, 8, 9, 10, 11, 12:
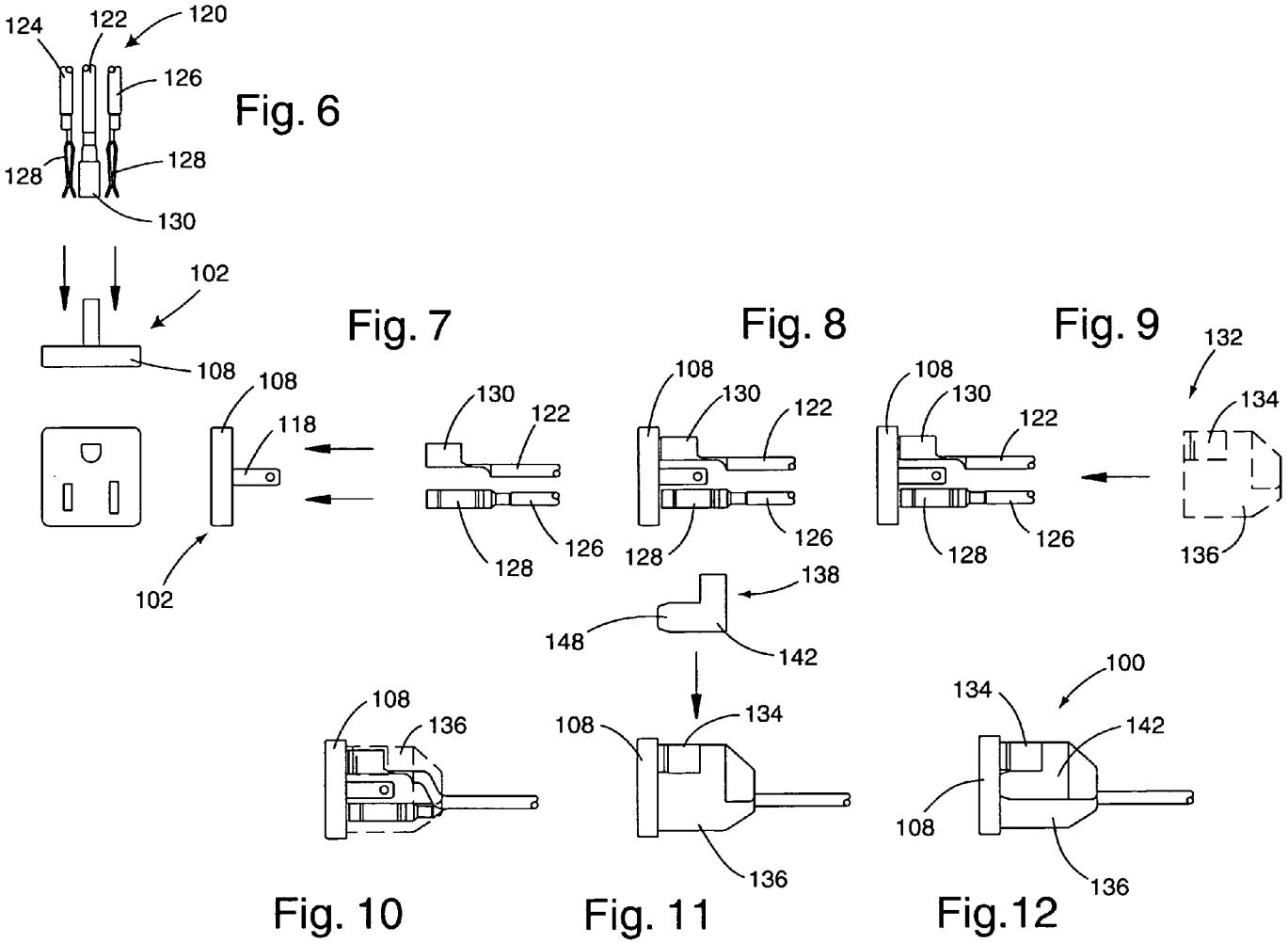
FIG. 6 is a partially exploded and plan view showing the relative positioning of the simplex receptacle body and electrical wires or cables to be connected to the simplex receptacle bodies.
FIG. 7 is a right-side view of the simplex receptacle body and the electrical wires or cables shown in FIG. 6.
FIG. 8 is a right-side view similar to FIG. 7, but showing the electrical wires or cables in an interconnected configuration with the simplex receptacle body.
FIG. 9 is a right-side view showing the interconnected electrical wires or cables and the simplex receptacle body, and further showing a sectional side view of the rear housing to be mounted to the simplex receptacle body.
FIG. 10 is a right-side elevation view similar to FIG. 9, but showing the sectional view of the rear housing as it is positioned when coupled to the simplex receptacle body.
FIG. 11 is a partially exploded and right side view showing the interconnected simplex receptacle body, electrical wires or cables, rear housing and the waterproofing clip positioned so as to be interconnected to the rear housing.
FIG. 12 is a right-side elevation view similar to FIG. 1, but showing the waterproofing clip in its interconnected position.
Figures 13, 14, 15, 16:
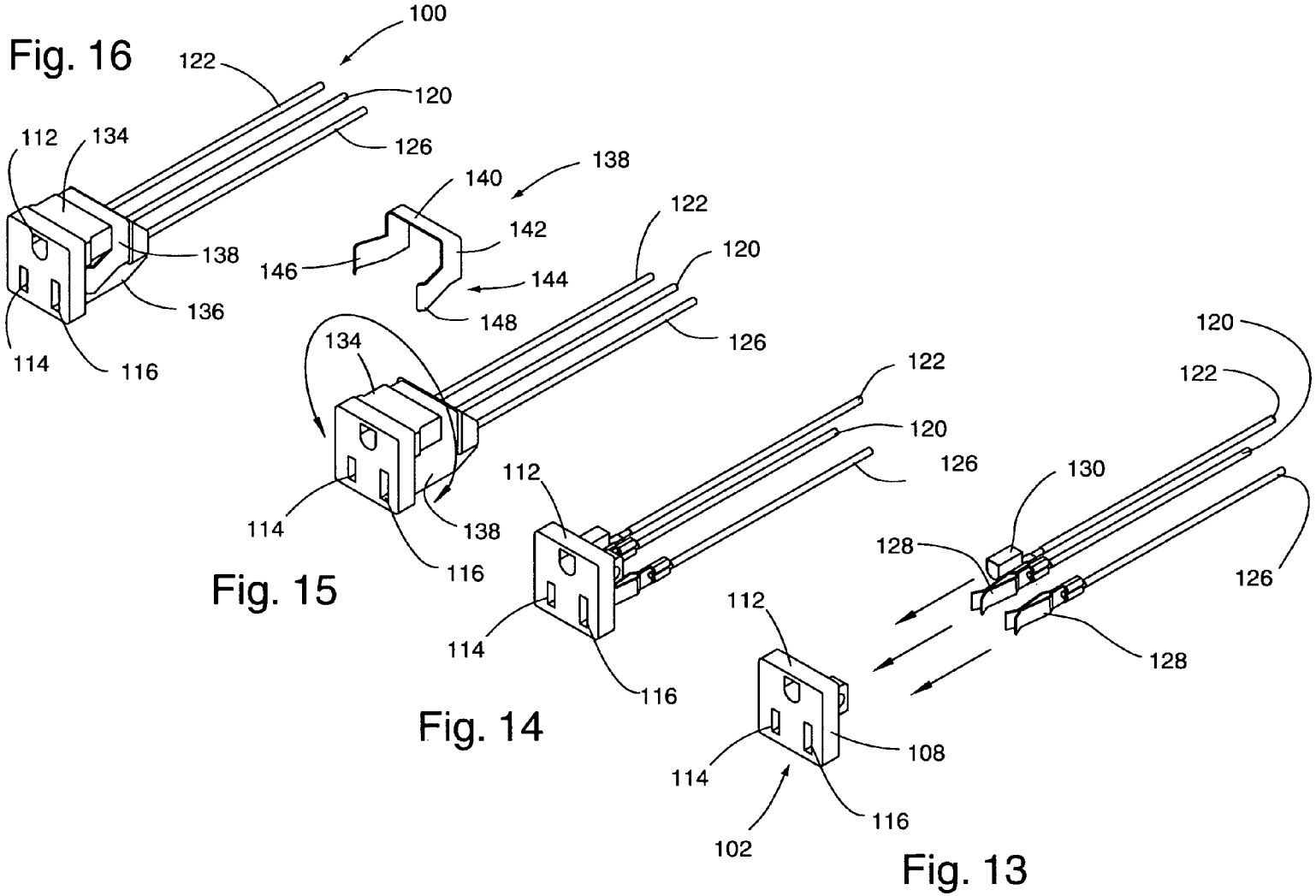
FIG. 13 is a perspective and partially exploded view, somewhat similar to FIG. 7, in that it shows the positioning of the electrical wires or cables as they are being interconnected to the simplex receptacle body.
FIG. 14 is a perspective view similar to FIG. 13, but showing the electrical wires or cables interconnected to the simplex receptacle body.
FIG. 15 is similar to FIG. 11, but shows, in perspective view, the interconnected simplex receptacle body, rear housing, electrical wires or cables, and the waterproofing clip in a position to be connected.
FIG. 16 is similar to FIG. 12, but shows the entire interconnection of the waterproof simplex receptacle in accordance with the invention, in perspective view.

With reference now to FIGS. 6–9, 13 and 14, the waterproof simplex receptacle 100 is adapted to be utilized with a set of electrical wires or cables 120. As shown, for example, in FIGS. 6 and 13, the electrical wires or cables 120 comprise three wires or cables. These three wires or cables 120 further comprise a ground wire 122, neutral wire 124 and hot wire 126. These wires are conventional in nature and may be separate wires, conduit or other type of cabling. Connected at the end of the ground wire 122 is a conventional ground connector 130. Connected to the ends of each of the neutral wire 124 and hot wire 126 is a female connector 128. Again, these connectors are conventional in nature. The ground connector 130 may be connected in any conventional manner to the ground terminal 112 of the simplex receptacle body 102. Correspondingly, the female connector 128 associated with the neutral wire 124 may be electrically connected to the neutral terminal 114 of the receptacle body 102. Still further, the female connector 128 associated with the hot wire 126 may be electrically connected in a conventional manner to the hot terminal 116 of the receptacle body 102. This interconnection is shown in FIGS. 8 and 14.

The waterproof simplex receptacle 100 in accordance with the invention further includes what is characterized as a rear housing 132. The rear housing 132 is shown in FIGS. 9, 10, 11, 12, 15 and 16. With reference to these drawings, the rear housing 132 has a shape and configuration whereby it can be secured to the rear surface 106 of the simplex receptacle body 102, in a manner so as to substantially enclose the electrical wires or cables 120. With reference to the drawings, the rear housing 132 includes an upper box-like structure 134. The upper box structure 134 extends lengthwise across the top of the rear surface 106 of the simplex receptacle body 102. Below the upper box 134 is a main housing body 136. The main housing body 136 has a substantially box-like configuration, and substantially encloses the female connectors 128 associated with the neutral and hot wires 124, 126 respectively. As shown in FIG. 9, the rear housing 132 is inserted as part of the simplex receptacle 100 through the electrical wires or cables 120, and connected by any conventional means to the rear surface 106 of the receptacle body 102.

In accordance with one of the principal concepts of the invention, the waterproof simplex receptacle 100 also includes a waterproofing clip 138. The waterproofing clip 138 is primarily shown in FIGS. 11, 12, 15 and 16. In particular, a perspective view of the waterproofing clip 138 is illustrated in FIG. 15. As shown therein, the waterproofing clip 138 includes an upper portion 140 extending lengthwise across the clip 138. A pair of vertical connecting portions 142 extend downwardly from opposing ends of the upper portion 140. At the lower ends of the vertical connecting portions 142, spring legs 144 extend forwardly from each of the vertical connecting portions 142. These elements of the waterproofing clip 138 may be separate and interconnected, or may preferably be constructed integral with each other. In particular, the spring clips 144 may be resilient in nature and sized so as to be "snap fitted" around the main housing body 136 of the rear housing 132. The spring legs 144 comprise a left leg 146 and right leg 148. As previously stated, the legs 144 are resilient in nature, so as to appropriately snap fit on the rear housing 132, thereby appropriately securing all elements fo the waterproof simplex receptacle 100. With the rear housing 132 and the waterproofing clip 138, the rear portion of the simplex receptacle 100 is essentially waterproof, and will resist any seepage of water or other liquids therein.

It should be emphasized that other configurations of the waterproof simplex may be utilized. Also, the concepts associated with the waterproof simplex may be applied to other types of receptacle configurations, such as duplex receptacles. As earlier mentioned, various types of electrical wires or cables may be utilized, and the simplex receptacle may have various terminal configurations, such as the absence of a ground terminal or the like. Still further, it is apparent that one of the advantages of waterproof simplex receptacles in accordance with the invention is that the rear housing and waterproofing clip may be "retrofitted" to existing simplex receptacles. Also, the concepts associated with the invention as embodied within the waterproof simplex receptacle 100 are not limited with respect to any particular sizes or dimensions of receptacles.

It will be apparent to those skilled in the pertinent arts that other embodiments of the invention can be designed. That is, the principles of the invention are not limited to the specific embodiments described herein. Accordingly, it will be apparent to those skilled in the art that modifications and other variations of the above-described illustrative embodiments of the invention may be effected without departing from the spirit and scope of the novel concept of the invention.

What is claimed is:

1. An electrical receptacle assembly having at least one receptacle, said receptacle configuration comprising:

a main receptacle body, having a plurality of terminals therein for receiving an electrical plug of an electrical device to be energized;

a plurality of electrical wires or cables, numbering the same as the number of electrical terminals associated with the main receptacle body, and adapted to provide electrical power when said electrical wires or cables are electrically coupled to the main receptacle body;

a rear housing forming an enclosure and adapted to be secured to a rear surface of said main receptacle body, said rear housing having means for receiving said electrical wires or cables, but being of a size and configuration so as to essentially prevent any water seepage into said housing; and a waterproofing clip having a resilient configuration and adapted to be snap fitted around said rear housing and coupled to said main receptacle body so as to appropriately secure said rear housing to said main receptacle body, characterized in that said clip comprises:

an upper portion extending lengthwise;

a pair of vertically connecting portions extending from opposing ends downwardly from said upper portion; and a pair of resilient legs extending forwardly from lower ends of said vertically connecting portions.

2. A waterproof simplex receptacle comprising:

a simplex receptacle body comprising a front portion, with said front portion having a front surface and a rear surface;

a plurality of terminals extending through said simplex receptacle body, said terminals comprising ground, neutral and hot terminals;

electrical wires or cables comprising a ground wire, a neutral wire and a hot wire;

a plurality of connectors, comprising a pair of female connectors, each connected to one of said neutral wire and said hot wire, and a ground connector connected to said ground wire;

a rear housing adapted to be secured to said rear surface of said simplex receptacle body; and a connecting clip having a resilient configuration and adapted to be snap fitted around said rear housing and coupled to said simplex receptacle body, so as to secure said rear housing to said simplex receptacle body in a manner which prevents water seepage into said rear housing, characterized in that said clip comprises:

an upper portion extending lengthwise across said clip;

a pair of vertical connecting portions each of said connecting portions extending downwardly from an opposing end of said upper portion; and a pair of resilient spring legs, each of said legs extending forwardly from a different one of the lower end of a vertical connecting position.

* * * * *